US009506180B2

(12) United States Patent
Webster et al.

(10) Patent No.: US 9,506,180 B2
(45) Date of Patent: Nov. 29, 2016

(54) CONTROL MECHANISM FOR WASHING MACHINE DRIVE WITH ACCELERATION SENSING

(71) Applicant: ILLINOIS TOOL WORKS INC., Glenview, IL (US)

(72) Inventors: Matthew C. Webster, Chepachet, RI (US); William D. Chatelle, Cranston, RI (US); Mark A. Romo, Holly, MI (US)

(73) Assignee: Illinois Tool Works, Inc., Glenview, IL (US)

( * ) Notice: Subject to any disclaimer, the term of this patent is extended or adjusted under 35 U.S.C. 154(b) by 117 days.

(21) Appl. No.: 14/408,975

(22) PCT Filed: Jun. 23, 2013

(86) PCT No.: PCT/US2013/047212

§ 371 (c)(1),
(2) Date: Dec. 18, 2014

(87) PCT Pub. No.: WO2014/004328

PCT Pub. Date: Jan. 3, 2014

(65) Prior Publication Data

US 2015/0191859 A1 Jul. 9, 2015

Related U.S. Application Data

(60) Provisional application No. 61/663,947, filed on Jun. 25, 2012.

(51) Int. Cl.

| | |
|---|---|
| ***D06F 37/20*** | (2006.01) |
| ***D06F 37/42*** | (2006.01) |
| ***D06F 33/02*** | (2006.01) |
| ***D06F 37/30*** | (2006.01) |

(52) U.S. Cl.
CPC ..... *D06F 37/203* (2013.01); *D06F 33/02* (2013.01); *D06F 37/304* (2013.01); *D06F 37/42* (2013.01)

(58) Field of Classification Search
CPC .... D06F 37/42; D06F 37/203; D06F 37/304; D06F 37/306; D06F 33/02; D06F 2222/00; D06F 2202/065
See application file for complete search history.

(56) References Cited

U.S. PATENT DOCUMENTS

| | | | | |
|---|---|---|---|---|
| 6,332,343 | B1 * | 12/2001 | Koketsu | D06F 37/304 68/12.02 |
| 7,107,798 | B2 | 9/2006 | Vaidhyanathan et al. | |
| 2003/0024280 | A1 * | 2/2003 | Peterson | D06F 33/02 68/12.01 |
| 2004/0259750 | A1 * | 12/2004 | DuVal | C11D 3/50 510/276 |
| 2006/0191337 | A1 | 8/2006 | Marioni | |
| 2007/0063603 | A1 * | 3/2007 | Levine | D06F 37/206 310/85 |
| 2008/0041114 | A1 * | 2/2008 | Dickerson | D06F 37/40 68/12.01 |
| 2009/0126465 | A1 * | 5/2009 | Kedjierski | A47L 15/4212 73/40.5 R |
| 2012/0011661 | A1 | 1/2012 | Wauer | |

FOREIGN PATENT DOCUMENTS

| | | | |
|---|---|---|---|
| DE | 102010039222 | A1 | 2/2012 |
| EP | 1696070 | A1 | 8/2006 |

OTHER PUBLICATIONS

ISR and WO for PCT/US2013/047212 mailed Aug. 5, 2013.

* cited by examiner

*Primary Examiner* — David Cormier
(74) *Attorney, Agent, or Firm* — Boyle Fredrickson, S.C.

(57) ABSTRACT

A transmission controller for an automatic washing machine incorporates an accelerometer to provide for sophisticated out-of-balance detection. Speed sensing and water moisture sensing may optionally be also incorporated into the transmission controller, the former providing a more sophisticated out-of-balance detection and the latter permitting overflow detection.

17 Claims, 5 Drawing Sheets

CONTROL MECHANISM FOR WASHING MACHINE DRIVE WITH ACCELERATION SENSING

CROSS-REFERENCE TO RELATED APPLICATIONS

This application claims the benefit of U.S. provisional application 61/663,947 filed Jun. 25, 2012 hereby incorporated in its entirety by reference.

FIELD OF THE INVENTION

The present invention relates to clothes washing machines and the like and specifically to a washing machine drive mechanism that senses irregularities in the operation of the washing mechanism.

BACKGROUND OF THE INVENTION

Washing machines, for example, for commercial or residential use, may provide an internal spin basket into which clothing may be placed. An agitator may extend into the spin basket for agitating or stirring the clothing during washing. The agitator and spin basket fit within a washtub retaining the water used for washing, and the water with the clothing inside the spin basket is drained through apertures in the spin basket.

In the process of washing, the washtub may be partially filled with water and/or detergent and other cleaning materials and the agitator may be reciprocated to dislodge dirt from the clothing. After or between one or more cycles of cleaning and rinsing, the water may be drained from the washtub and the spin basket may be rotated rapidly in a spin cycle to remove water from the clothing by centrifugal force.

The various motions of the spin basket and agitator may be provided by a motor/transmission assembly typically mounted on the outside of the washtub as supported by the washtub. The washtub itself is normally suspended from the washing machine housing so as to permit slight movement of the washtub with respect to the housing of the washing machine during operation. This mounting reduces the transmission of vibration from the washtub to the housing during the washing operations.

When the spin basket is rotated in the spin cycle, an uneven distribution of the clothing within the spin basket can generate strong forces which may potentially cause damaging motion of the washtub. For this reason, it is known to place a "kick out" switch in proximity with the washtub on the housing surrounding the washtub. The kick out switch may be actuated with extreme washtub motion to stop the spin cycle. It is desirable that the kick out switch be positioned so that it does not unnecessarily stop the washing process until the clothing is reliably fully clean and spun dry. This setting process is difficult, however, because motion of the washtub can vary significantly at different spin basket speeds and loadings.

SUMMARY OF THE INVENTION

The present invention provides a washing machine transmission component that can accurately sense acceleration of the washtub using an electronic accelerometer mechanically coupled to the washtub to provide more sophisticated out-of-balance detection. The accelerometer may be associated with a transmission control component incorporating a microprocessor for transmission control, and in this way may share microprocessor functionality with the transmission control.

Specifically, one embodiment of the invention provides a washing machine transmission controller having a housing positionable adjacent to a washing machine transmission to move therewith. Electrical conductors pass from the housing to communicate with an external washing machine controller and the housing supports an electronic actuator providing a control arm extending from the housing and receivable by the washing machine transmission to shift the washing machine transmission according to movement of the control arm. An accelerometer attached to move with the washing machine washtub provides an acceleration signal indicating acceleration of the washtub and communicates this acceleration signal to electronic circuitry supported by the housing and communicating with the electronic actuator and the electrical conductors. Circuitry operates to receive transmission control signals over the electrical conductors for control of the electronic actuator and to communicate corresponding control signals to the electronic actuator and to transmit out-of-balance signals over the electrical conductors based on the acceleration signal.

It is thus a feature of at least one embodiment of the invention to provide a cost-efficient way of providing sophisticated acceleration sensing of the washtub by incorporating acceleration sensor with pre-existing electrical circuits for transmission control.

The out-of-balance signal indicates a magnitude of acceleration detected by the accelerometer.

It is thus a feature of at least one embodiment of the invention to provide an extremely simple addition to a transmission control circuit that transmits raw acceleration signals.

The washing machine transmission controller may further include a tachometer positioned to communicate with the spin basket for measuring spin basket speed to produce a spin basket speed signal communicated with the electronic circuitry.

It is thus a feature of at least one embodiment of the invention to provide a spin basket speed signal that may be used by the washing machine controller to assess washing mechanism operation.

The out-of-balance signal provided by the washing machine transmission controller may be a function of the spin basket speed signal and acceleration signal.

It is thus a feature of at least one embodiment of the invention to make use of the spin basket speed for more sensitive out-of-balance detection less prone to false triggering.

For example, a threshold for producing an out-of-balance signal may be a function of acceleration magnitude that rises with increasing spin basket speed.

It is thus a feature of at least one embodiment of the invention to decrease sensitivity to acceleration at high spin basket speeds where high accelerations may be expected for in-balance operation.

The electronic circuitry may determine a periodicity of the acceleration signal and the out-of-balance signal is a function of spin basket speed and periodicity of the acceleration signal.

It is thus a feature of at least one embodiment of the invention to provide sensitive out-of-balance detection that can look for accelerations having a period related to the spin basket speed and thus implicitly caused by an out-of-balance load.

For example, a threshold for producing an out-of-balance signal may be a function of periodicity of the acceleration signal that falls with increasing spin basket speed.

It is thus a feature of at least one embodiment of the invention to distinguish between incidental high accelerations and those related to out-of-balance loads.

The out-of-balance signal may be a function of spin basket speed signal and acceleration signal and period of the acceleration signal.

It is thus a feature of at least one embodiment of the invention to provide a combination measurement that assesses both acceleration magnitude and acceleration period against spin basket speed for the reasons described above.

The washing machine transmission controller may further include a water sensor detecting water spilling from the spin basket and wherein the electronic circuitry provides an overflow signal based on the water sensor.

It is thus a feature of at least one embodiment of the invention to cost-effectively combine multiple functions into the transmission controller to reduce wiring and circuitry costs.

The water sensor may be a pair of conductive plates on an outer surface of the housing monitored for electrical flow between the plates.

It is thus a feature of at least one embodiment of the invention to provide a simple method of overflow detection that may be readily implemented by control circuitry.

The accelerometer may provide dual axis acceleration measurements along a vertical axis aligned with an axis of rotation of a spin basket within the washtub and a horizontal axis perpendicular to the vertical axis and wherein the electronic circuitry transmits a signal based on vertical acceleration.

It is thus a feature of at least one embodiment of the invention to permit sophisticated child entrapment detection by distinguishing between acceleration vectors.

The electronic circuitry further generates an entrapment signal based on an acceleration signal and at least one second signal indicating the acceleration is not the result of washing motion.

It is thus a feature of at least one embodiment of the invention to detect possible child entrapment by the existence of accelerations at times where no washing motion is expected.

The electronic circuitry may be a microprocessor executing a program stored in non-transitive medium and the transmission control signals and the acceleration signals are serial data signals decoded and coded by the microprocessor.

It is thus a feature of at least one embodiment of the invention to provide multifunctionality to the transmission controller without unduly increasing wiring harness costs.

Other features and advantages of the invention will become apparent to those skilled in the art upon review of the following detailed description, claims and drawings in which like numerals are used to designate like features.

Figure 1:
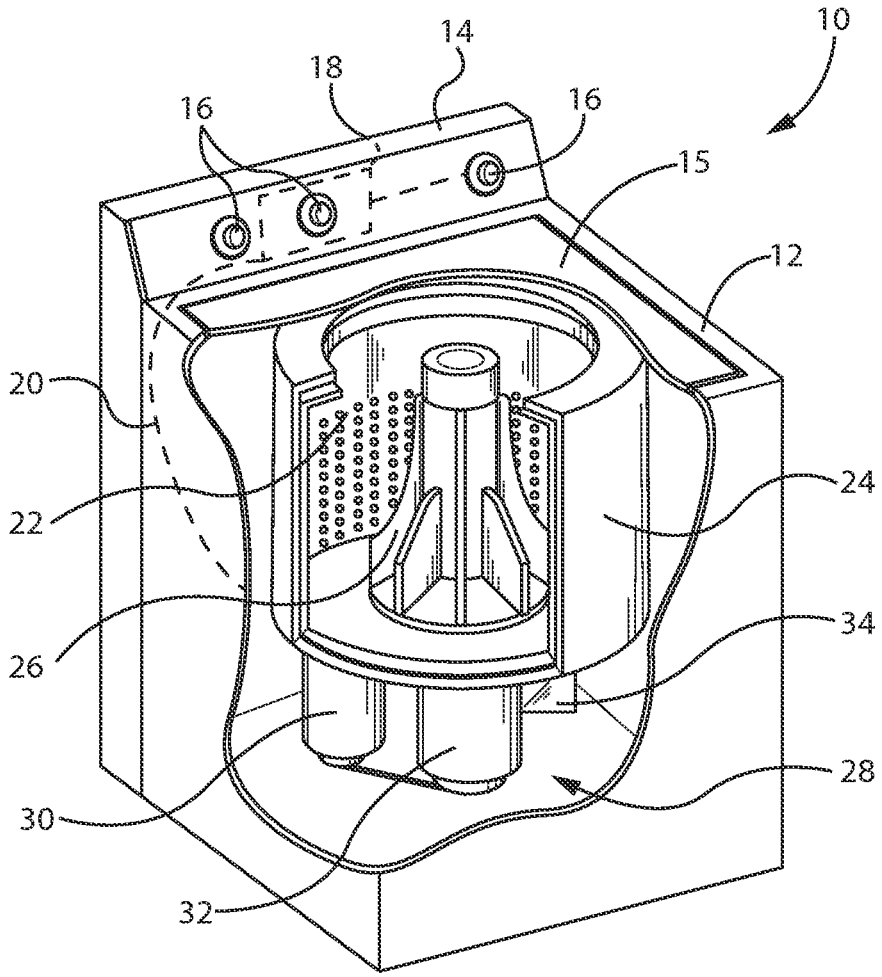
FIG. 1 is a perspective cutaway view of an automatic washer suitable for use with the present invention showing an agitator within a spin basket held within a washtub, the latter supporting a transmission/drive system.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a washing machine 10 may provide for an outer housing 12 having a control console 14 at the rear edge thereof providing for controls 16 (such as switches and indicator lights) for controlling the operation of the washing machine 10. The control 16 may communicate with an internal controller 18 typically providing for a microprocessor communicating with various components of the washing machine 10 through a wiring harness 20. The outer housing 12 may provide a hinged lid 15 at the top that may be opened for access by a user to the interior of a spin basket 22, the latter fitting inside a washtub 24. An agitator 26 may extend upward from the bottom of the spin basket 22 as is generally understood in the art.

Figure 2:
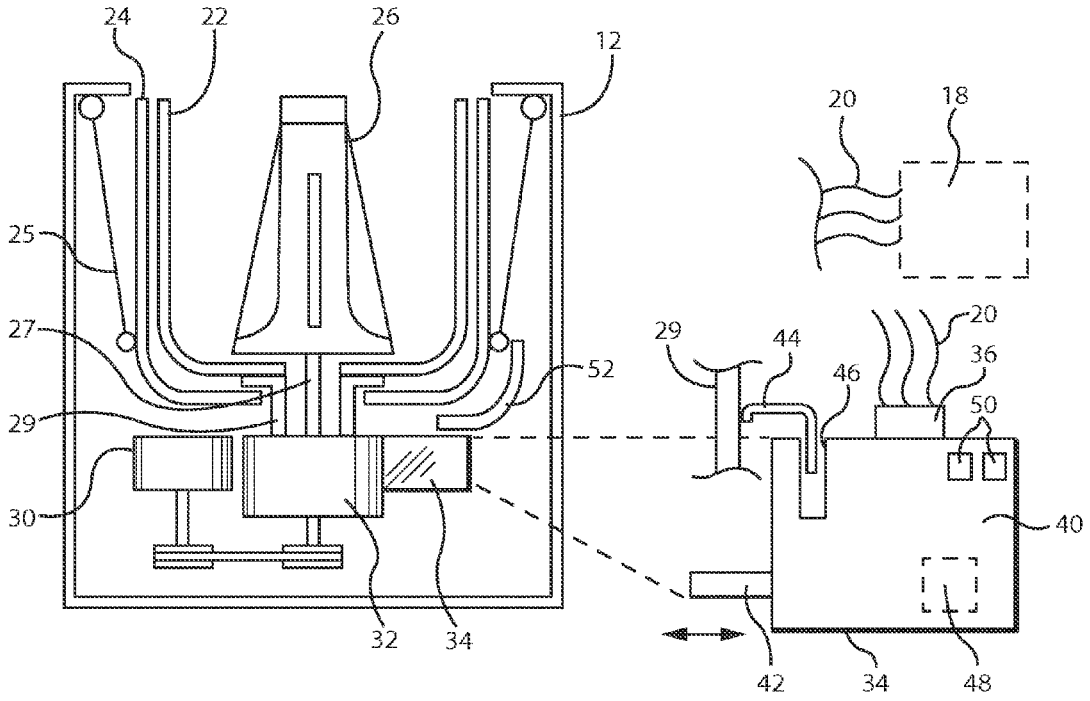
FIG. 2 is a simplified cross-section of the elements of FIG. 1 showing a motor, transmission and transmission controller forming the transmission/drive system with an expanded fragmentary view of the transmission controller.

Referring now to FIG. 2, the washtub 24 may be generally suspended on damper rods 25 or the like from the housing 12 to provide for some lateral motion during use. Suspended at the bottom outside of the washtub 24 may be a transmission drive assembly 28 including a motor 30, a transmission 32, and a transmission controller 34 communicating with the transmission 32 to change its mode of operation between conducting motion of the motor 30 to the agitator 26 through shaft 27 and conducting motion of the motor 30 to the spin basket 22 through collar 29. The transmission controller 34 will generally have a housing 40 that may be physically attached to the transmission 32 by machine screws or the like (not shown) or otherwise attached to a common supporting structure. In this way the transmission controller 34 will move with the transmission, the latter of which adopts the motion of the washtub 24 on which it is supported.

Generally, the transmission controller 34 may provide a connector 36 connecting to a wiring harness 20 communicating with the controller 18 to receive power and control signals therefrom and to provide sensor signals thereto. The transmission controller 34 may provide for a housing 40 with an actuator arm 42 extendable therefrom under control of the transmission controller 34. The actuator arm 42 may communicate with the internal mechanism of the transmission 32 to shift the same between operating modes as is generally understood in the art. An example transmission 32 suitable for this purpose is described in U.S. Pat. No. 7,107,798 hereby incorporated by reference.

The transmission controller 34 may receive an interrupter vane 44 passing through a slot 46 in the housing 40, the interrupter vane 44 communicating with the collar 29 and thus to spin basket 22 to move with the spin basket and thereby interrupt a light beam from an internal sensor (to be described below) in the transmission controller 34 so that the transmission controller 34 can derive a speed signal related to a speed of rotation of the spin basket 22.

The housing 40 of the transmission controller 34 may support accelerometer 48, for example a MEMs accelerometer, providing a signal proportional to acceleration along a horizontal axis and optionally a vertical axis. Conveniently, the accelerometer 48 may be placed within the housing 40 however, remote placement is also possible so long as the accelerometer 48 communicates with the transmission controller 34 to detect motion of the washtub 24.

In addition, the housing 40 may expose metallic conductor plates 50 on its outer surface that may be used to detect moisture caused by overflow of liquid from the washtub 24. In this regard, drip conducting features such as a funnel 52, drip ledge or the like may be placed on the washtub 24 or supporting structure or incorporated into the housing 40 to direct overflow water to the conductor plates 50. Alternatively the conductor plates 50 may be on a separate structure that may be connected to the transmission controller, for example by cabling, with the separate structure placed on the washtub 24.

Figure 3:
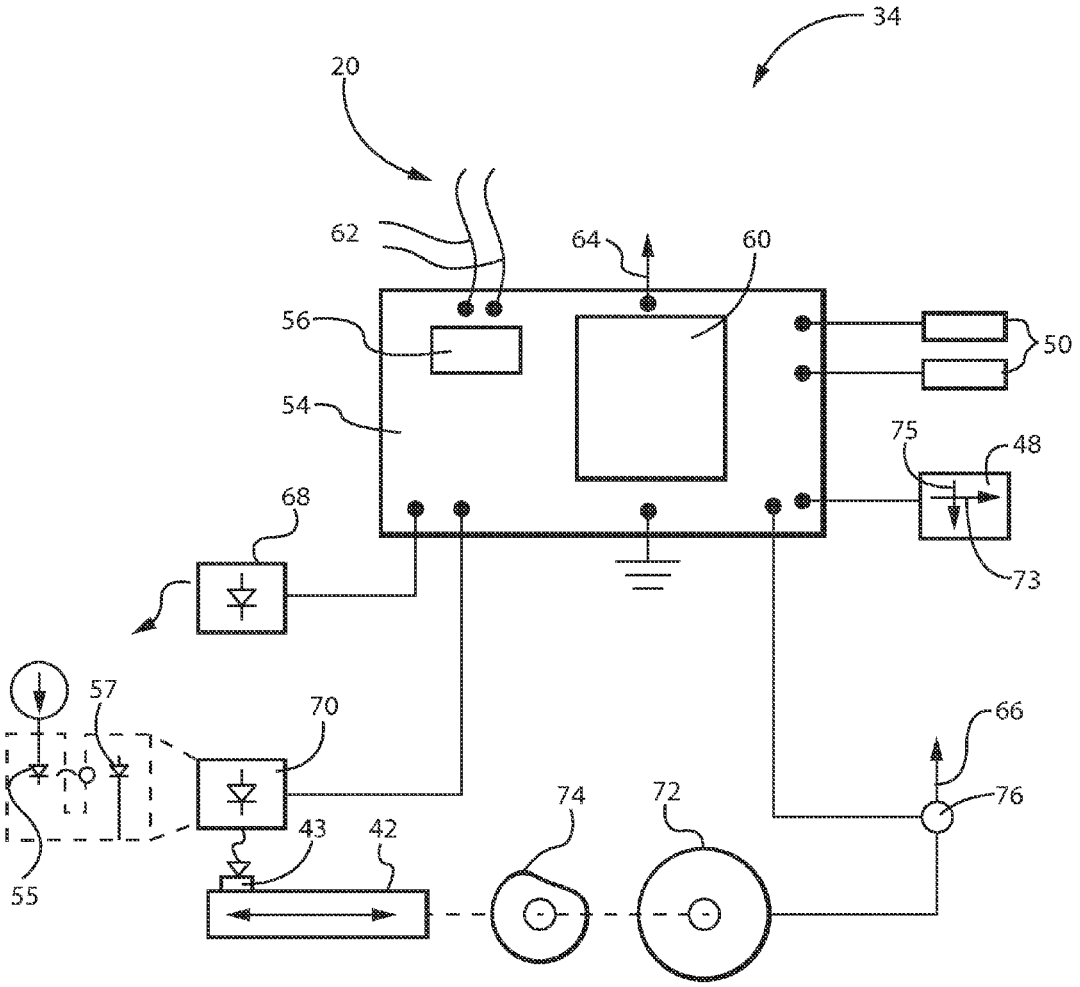
FIG. 3 is a block diagram of the transmission controller as incorporating multiple sensors and drive elements for controlling the transmission/drive system and including a microcontroller executing a stored program.

Referring now to FIG. 3, the transmission controller 34 may include an internal microcontroller 54 having a processor 56 that may execute a stored program 60 as will be described below. The microcontroller 54 may provide for a serial communication protocol allowing for serial communication of data over conductors 62 of the wiring harness 20, for example, using any of a number of well-known serial communication standards as implemented in hardware and software of the microcontroller 54. Generally, the microcontroller 54 will receive a source of DC power 64 but may optionally receive a source of AC power 66, the latter of which may be used to derive the source of DC power 64.

The microcontroller 54 may communicate with optical interrupters sensors 68 and 70, the former detecting interruptions by vane 44 (shown in FIG. 2), and the latter monitoring motion of the arm 42, for example, by detecting a vane 43 or other feature on the arm 42. Generally, a feedback signal obtained by sensor 70 monitoring the position of the arm 42 will be used to control the position of the arm 42 to various positions to provide for agitation and/or spin. Such optical interrupters sensors 68 and 70 may provide for an opposed LED 55 driven by a current source and sensor 57 (which may also be an LED) providing a signal to the microcontroller 54, for example a voltage drop with respect to an internal or external pull up resistor detected by an analog to digital control input as is generally understood in the art.

The arm 42 may be driven by an AC gear motor 72 communicating with a cam 74, a can following the surface of the arm 42 pressing against the cam 74. The motor 72 may be controlled by solid-state switching elements 76 in turn controlled by the microcontroller 54. Various different actuators are also contemplated including wax motors, solenoids, and different types of motors including both AC and DC motors with gear heads and without.

The microcontroller 54 may also receive one or more analog or digital signals from the accelerometer 48 to derive acceleration along one or both of a horizontal axis 73 or perpendicular vertical axis 75 generally aligned with axis of rotation of the spin basket 22 (shown in FIG. 1) and may measure electrical properties across the conductor plates 50, including, for example, resistance or capacitance according to well-known techniques, for example, by applying DC or AC voltage to one of the conductor plates 50 and measuring received current from the other conductor plates 50. A current above a predetermined threshold indicating conduction may be used to infer the presence of moisture or water bridging the conductor plates 50, for example, caused by overflow of the washtub 24.

Figure 5:
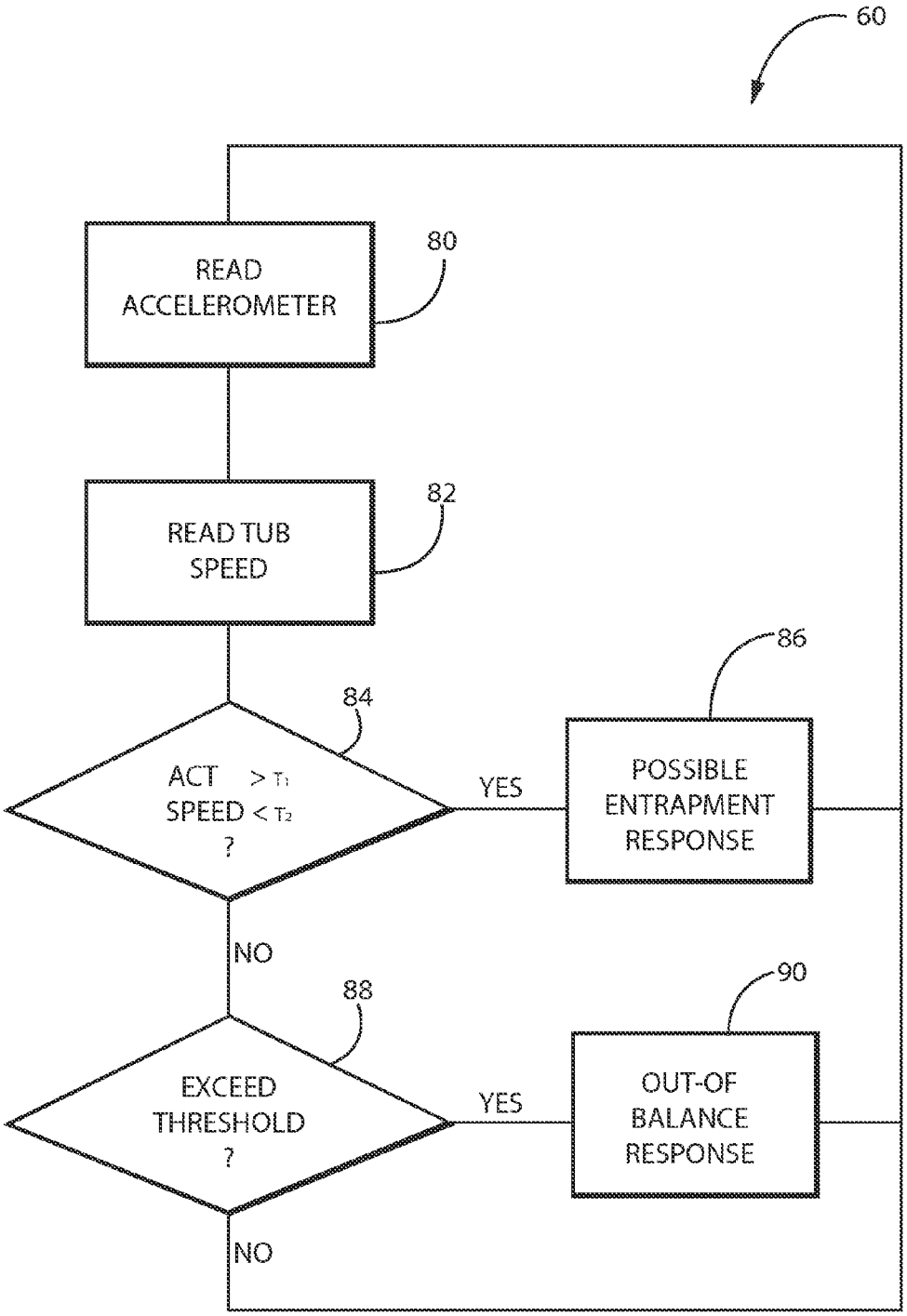
FIG. 5 is a flowchart of the program executed by the microcontroller of FIG. 3.

Referring now to FIGS. 1, 3 and 5, the program 60, in addition to controlling the shifting of the transmission 32 according to commands from the controller 18 (shown in FIG. 1) over conductors 62, may operate to read acceleration signals from the accelerometer 48 as indicated by process block 80 and read washtub speed as indicated by process block 82 through the signals provided by sensors 68 and 70. During process block 80, acceleration magnitude over a sample interval may be obtained and acceleration period, indicating generally the cyclicity of acceleration, may be determined by a conventional technique such as zero crossing detection or the like. At decision block 84, if acceleration above a predetermined threshold $T_1$ along a particular one of or both of axes 73 and 75 for predetermined duration is sensed, with a washtub speed below a second predetermined threshold $T_2$ indicating, for example, movement of the washtub 24 when there is no washtub rotation, the program 60 proceeds to process block 86 to respond to a possible entrapment of a child playing within the spin basket 22, or an animal trapped in the spin basket 22. This response of process block 86 may be, for example, a prevention of shifting of the actuator arm 42 so as to cause a spin or agitation cycle as may be accomplished by the transmission controller or, for a reporting of entrapment to the controller 18, to prevent locking of the lid 15 or starting of a spin cycle, and/or to provide an alarm signal to the user. The detection process of decision block 84 may, for example, detect only vertical acceleration (not typically associated without balance) or may detect both vertical and horizontal acceleration at particular times when the agitator or spin basket is not in use (for example, using the signal from the tachometer or from the external controller 18) and no acceleration should be detected, and may apply different thresholds to these different axes or cycle time periods.

If the conditions of decision block 84 are not met, the program 60 proceeds to decision block 88 to determine if acceleration measured by accelerometer 48 would indicate an out-of-balance condition has been met. This test may also include the precedent condition of motion of the spin basket 22 or agitator 26, the former determined from the sensors 68 or both determined from control signals sent by the external controller 18 indicating command signals for engaging one of the spin basket 22 or agitator 26.

Figure 4A:
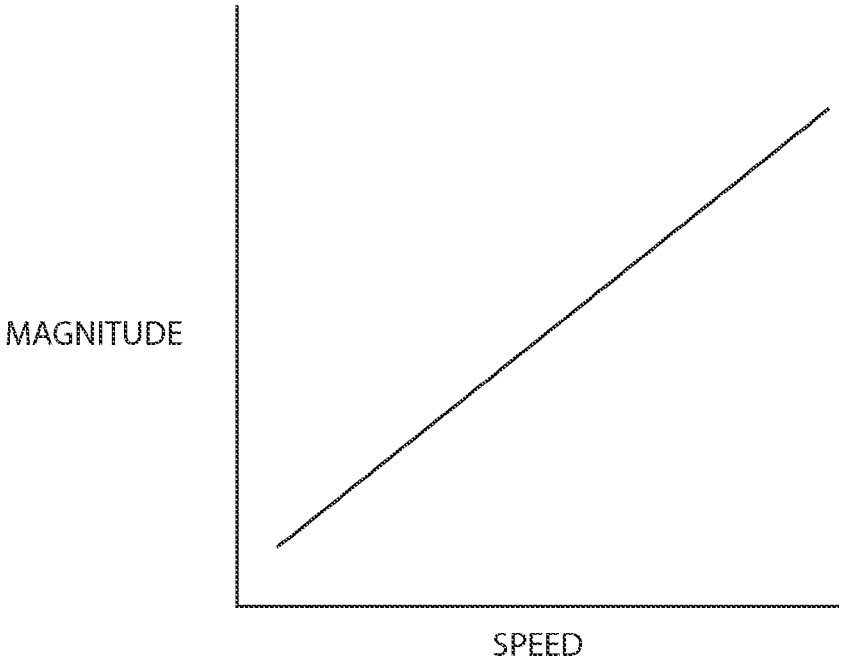
FIGS. 4*a* and 4*b* are plots of washtub speed versus lateral acceleration threshold and versus lateral acceleration period, respectively, that may be used by the stored program of the drive components or an associated controller.
Figure 4B:
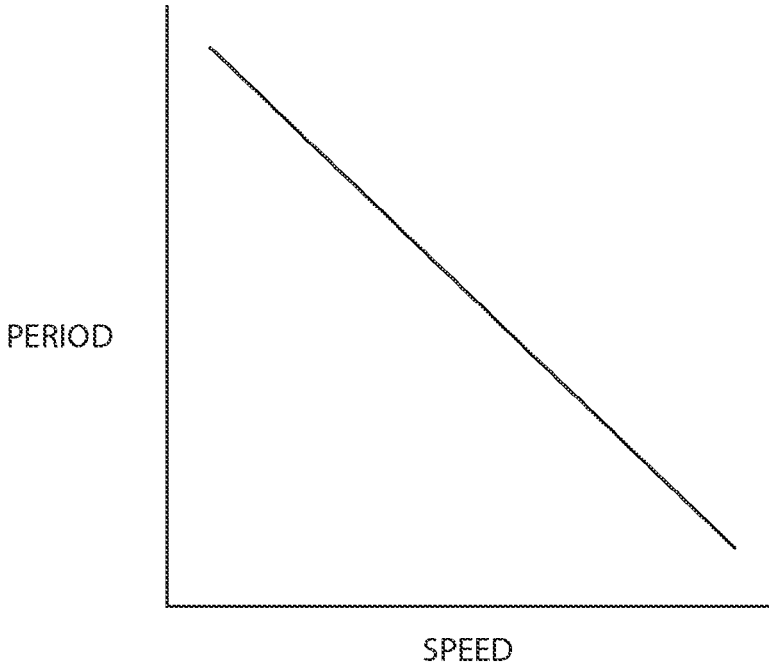

Referring also to FIG. 4, in this regard the present invention allows a sophisticated dynamic acceleration threshold to be adopted being a function of the lateral acceleration magnitude and/or lateral acceleration period. Generally, the acceleration magnitude threshold along the horizontal axis for triggering an out-of-balance condition may increase as the speed of the spin basket increases as shown in FIG. 4*a*. This reflects the fact that at high spin basket speeds, relatively small excursions that are not associated with out-of-balance will produce higher lateral accelerations. Conversely, the acceleration period threshold for triggering an out-of-balance condition may decrease as the speed of the spin basket increases as shown in FIG. 4*b*. This reflects the fact that at low spin basket speeds, the periodicity of serious excursions will be longer and also allows a correlation between the acceleration and possible imbalance in the spin basket which will tend to have imbalance periodicity matching the period of rotation of the spin basket 22. These two contributions may be combined with a weighted sum or other functional relationship.

If at decision block 88 the acceleration threshold is exceeded, the program 60 proceeds to decision block 90 to provide for an out-of-balance response, for example, including stopping the spin cycle, adopting various load balance adjustment strategies (manipulating the spin basket to shift clothing therein), setting an alarm or the like.

Alternatively the program 60 may simply forward these speed and acceleration values through the conductor 62 to be processed by comparable programming in the controller 18.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best triodes known for practicing the invention and will enable others skilled in the art to utilize the invention.

We claim:

1. A washing machine transmission controller for control of a washing machine transmission, the washing machine transmission being of a type supported on a washing machine washtub for controlling washing motion comprising:

a housing positionable adjacent to a washing machine transmission to move therewith;

electrical conductors adapted to communicate with an external washing machine controller;

an electronic actuator supported by the housing providing a control arm extending from the housing and receivable by the washing machine transmission to shift the washing machine transmission according to movement of the control arm;

an accelerometer supported to move with the washing machine washtub and providing an acceleration signal indicating acceleration of the washtub; and electronic circuitry supported by the housing and communicating with the electronic actuator, the accelerometer and the electrical conductors, the electronic circuitry configured to receive transmission control signals from the external washing machine controller over the electrical conductors for control of the electronic actuator and to communicate corresponding control signals to the electronic actuator and to transmit out-of-balance signals over the electrical conductors to the external washing machine controller based on the acceleration signal.

2. The washing machine transmission controller of claim 1 wherein the electronic circuitry transmits out-of-balance signals to the external washing machine controller indicating a magnitude of acceleration detected by the accelerometer.

3. The washing machine transmission controller of claim 1 further including at least one control arm sensor communicating with the electronic circuitry for determining a position of the control arm to provide feedback control of the control arm position.

4. The washing machine transmission controller of claim 1 wherein the electronic actuator is an electric motor.

5. The washing machine transmission controller of claim 1 further including a tachometer positioned to communicate with a spin basket of the washing machine for measuring spin basket speed to produce a spin basket speed signal when the housing is positioned adjacent to the washing machine transmission, the tachometer communicating with the electronic circuitry.

6. The washing machine transmission controller of claim 5 wherein the electronic circuitry is configured to process the spin basket speed signal and the acceleration signal to transmit an out-of-balance signal indicating an out-of-balance condition as a function of spin basket speed signal and acceleration signal.

7. The washing machine transmission controller of claim 6 wherein the electronic circuitry is configured to generate the out-of-balance signal indicating an out-of-balance condition by applying a threshold to acceleration magnitude of the acceleration signal, and wherein the threshold is a function of the spin basket speed signal for producing an out-of-balance signal indicating an out-of-balance condition as a function of acceleration magnitude that rises with increasing spin basket speed.

8. The washing machine transmission controller of claim 5 wherein the electronic circuitry determines a period of the acceleration signal and the out-of-balance signal provided by the electronic circuitry indicates an out-of-balance condition as a function of spin basket speed and period of the acceleration signal.

9. The washing machine transmission controller of claim 8 wherein a threshold used by the electronic circuit for producing an out-of-balance signal is a function of periodicity of the acceleration signal that falls with increasing spin basket speed.

10. The washing machine transmission controller of claim 5 wherein the electronic circuitry is configured to provide an out-of-balance signal indicating an out-of-balance condition is a function of spin basket speed signal and acceleration signal and period of the acceleration signal.

11. The washing machine transmission controller of claim 1 further including a water sensor detecting water spilling from the washtub and wherein the electronic circuitry provides an overflow signal based on the water sensor.

12. The washing machine transmission controller of claim 11 wherein the water sensor is a pair of conductive plates on an outer surface of the housing monitored for electrical flow between the plates.

13. The washing machine transmission controller of claim 1 wherein the accelerometer provides dual axis acceleration measurements along a vertical axis aligned with an axis of rotation of a spin basket within the washtub and a horizontal axis perpendicular to the vertical axis and wherein the electronic circuitry transmits a signal based on vertical acceleration.

14. The washing machine transmission controller of claim 1 wherein the electronic circuitry further generates an entrapment signal based on an acceleration signal and at least one second signal indicating the acceleration is not a result of washing motion.

15. The washing machine transmission controller of claim 1 wherein the electronic circuitry is a microprocessor executing a program stored in non-transitive medium.

16. The washing machine transmission controller of claim 15 wherein the transmission control signals and the acceleration signal are serial data signals decoded and coded by the microprocessor.

17. A washing machine of a type having a transmission supported on a washing machine washtub for controlling washing motion and including a transmission controller comprising:

a housing positionable adjacent to a washing machine transmission to move therewith;

electrical conductors adapted to communicate with an external washing machine controller;

an electronic actuator supported by the housing providing a control arm extending from the housing and receivable by the washing machine transmission to shift the washing machine transmission according to movement of the control arm;

an accelerometer supported to move with the washtub and providing an acceleration signal indicating acceleration of the washtub; and electronic circuitry supported by the housing and communicating with the electronic actuator, the accelerometer and the electrical conductors to receive transmission control signals from the external washing machine controller over the electrical conductors for control of the electronic actuator and to communicate corresponding control signals to the electronic actuator, and to transmit out-of-balance signals over the electrical conductors to the external washing machine controller based on the acceleration signal.

* * * * *